United States Patent [19]

Davis et al.

[11] Patent Number: 4,902,010

[45] Date of Patent: Feb. 20, 1990

[54] BALANCING SKILL GAME

[76] Inventors: Jean A. Davis, 3174 Briarhill, Milford, Mich. 48042; William R. McDunnough, 6240 Bullard Rd., Fenton, Mich. 48430

[21] Appl. No.: 272,227

[22] Filed: Nov. 16, 1988

Related U.S. Application Data

[63] Continuation of Ser. No. 894,284, Aug. 7, 1986, abandoned.

[51] Int. Cl.[4] ..... A63F 9/00

[52] U.S. Cl. ..... 273/1 GF

[58] Field of Search ..... 273/1 GF; D21/102, 108

[56] References Cited

U.S. PATENT DOCUMENTS

| | | | |
|---|---|---|---|
| 2,458,306 | 1/1949 | Schneider | 273/1 GF |
| 3,537,706 | 11/1970 | Heavener, Jr. | 273/1 GF |
| 4,303,240 | 12/1981 | Ellman et al. | 273/1 GF |

OTHER PUBLICATIONS

Sears Christmas Book 1968, 9–1968, p. 452, Playskool Kindergarten Blocks.

Sunset Childrens Furniture ®1985, p. 27.

Playthings, vol. 58, No. 6, 6–1960, Blockhead Game.

*Primary Examiner*—Paul E. Shapiro

*Attorney, Agent, or Firm*—James M. Deiman

[57] ABSTRACT

A game based upon the balancing of dissimilar shaped blocks, one upon the other in sequence, until the construct topples or no more blocks can be added. The game features blocks varying not only in shape and size to a substantial extent but also varying in density, surface texture and subtle geometric adjustments not easily discernable to the player without considerable practice and experience with the game. In particular, on some pieces angles that appear to be perpendicular are not, pieces that appear to be massive are not and with some adjoining pieces friction between engaging surfaces substantially differs from the friction between other engaging surfaces. Scoring rules matched to the game set of blocks provide a hand eye coordination challenge to players of all ages.

5 Claims, 5 Drawing Sheets

| NO. | PIECES | LENGTH INCHES | STOCK INCHES | WOOD SPECIES |
|---|---|---|---|---|
| 12. | 45° | 1 1/8 | 3/4 O'TS'D' CORNER | PINE |
| 13 | 45° | 1 3/4 | 3/4 O'TS'D' CORNER | PINE |
| 14 | 90° 90° | 2 1/2 | 1/4 QU'RT'R ROUND | PINE |
| 15 | 90° 45° | 1 1/8 | 1 ROUND | BIRCH HARD MAPLE |
| 16 | 45° 45° | 1 3/4 | 1 ROUND | BIRCH HARD MAPLE |
| 17 | 90° 90° | 5/8 | 1 ROUND | BIRCH HARD MAPLE |
| 18 | | 7/16 | 1 1/16 O'TS'D' CORNER | PINE |
| 19 | 88° 90° | 11/16 | 1/4 HALF ROUND | PINE |
| 20 | 88° 90° | 6 | 1/2 HALF ROUND | PINE |
| 21 | 70° 70° | 1 | 1/2 QU'RT'R ROUND | PINE |
| 22 | 90° 90° | 3/4 | 3/4 × 3/4 | POPLAR SOFT MAPLE |

FIG. 1A

| NO. | PIECES | LENGTH INCHES | STOCK INCHES | WOOD SPECIES |
|---|---|---|---|---|
| 1 | 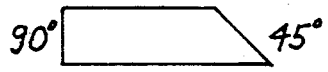  | $2\frac{1}{2}$ | $\frac{3}{4} \times \frac{3}{4}$ | POPLAR SOFT MAPLE |
| 2 | 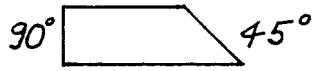  | $1\frac{1}{2}$ | $\frac{3}{4} \times \frac{3}{4}$ | POPLAR SOFT MAPLE |
| 3 | 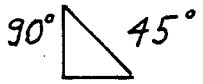  | $\frac{3}{4}$ | $\frac{3}{4} \times \frac{3}{4}$ | POPLAR SOFT MAPLE |
| 4 | 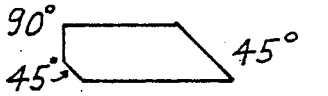  | $1\frac{1}{2}$ | $\frac{3}{4} \times \frac{3}{4}$ | POPLAR SOFT MAPLE |
| 5 | 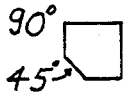  | $\frac{3}{4}$ | $\frac{3}{4} \times \frac{3}{4}$ | POPLAR SOFT MAPLE |
| 6 | 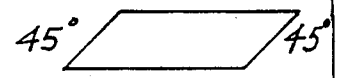  | $2\frac{1}{2}$ | $\frac{3}{4} \times \frac{3}{4}$ | POPLAR SOFT MAPLE |
| 7 | 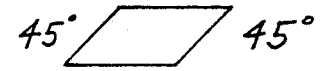  | $1\frac{1}{2}$ | $\frac{3}{4} \times \frac{3}{4}$ | POPLAR SOFT MAPLE |
| 8 | 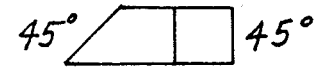  | $1\frac{1}{2}$ | $\frac{3}{4} \times \frac{3}{4}$ | POPLAR SOFT MAPLE |
| 9 | 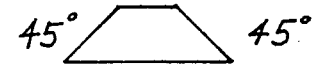  | $1\frac{11}{16}$ | $\frac{3}{4} \times \frac{3}{4}$ | POPLAR SOFT MAPLE |
| 10 | 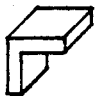 | $\frac{1}{2}$ | $\frac{3}{4}$ O'TS'D' CORNER | PINE |
| 11 | 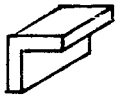 | $1\frac{5}{8}$ | $\frac{3}{4}$ O'TS'D' CORNER | PINE |

FIG. 1B

| NO. | PIECES | LENGTH INCHES | STOCK INCHES | WOOD SPECIES |
|---|---|---|---|---|
| 12 | 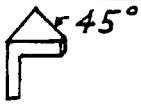  | $1\frac{1}{8}$ | $\frac{3}{4}$ O'TS'D' CORNER | PINE |
| 13 | 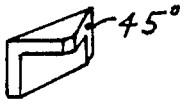  | $1\frac{3}{4}$ | $\frac{3}{4}$ O'TS'D' CORNER | PINE |
| 14 | 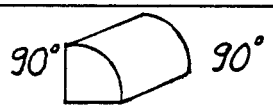  | $2\frac{1}{2}$ | $\frac{1}{2}$ QU'RT'R ROUND | PINE |
| 15 | 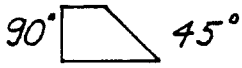  | $1\frac{1}{8}$ | 1 ROUND | BIRCH HARD MAPLE |
| 16 | 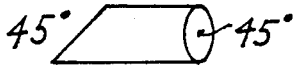  | $1\frac{3}{4}$ | 1 ROUND | BIRCH HARD MAPLE |
| 17 | 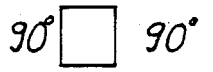  | $\frac{5}{8}$ | 1 ROUND | BIRCH HARD MAPLE |
| 18 | 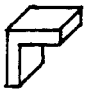 | $\frac{7}{16}$ | $1\frac{1}{16}$ O'TS'D' CORNER | PINE |
| 19 | 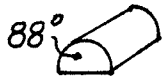  | $\frac{11}{16}$ | $\frac{1}{2}$ HALF ROUND | PINE |
| 20 | 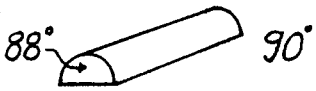  | 6 | $\frac{1}{2}$ HALF ROUND | PINE |
| 21 | 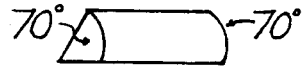  | 1 | $\frac{1}{2}$ QU'RT'R ROUND | PINE |
| 22 | 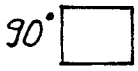  | $\frac{3}{4}$ | $\frac{3}{4} \times \frac{3}{4}$ | POPLAR SOFT MAPLE |

FIG. 1C

| NO. | PIECES | LENGTH INCHES | STOCK INCHES | WOOD SPECIES |
|---|---|---|---|---|
| 23 | 90° 90° | $1\frac{5}{8}$ | $\frac{1}{2} \times \frac{3}{4}$ | POPLAR SOFT MAPLE |
| 24 | 70° 70° | 3 | $1\frac{1}{2} \times \frac{3}{4}$ | RED WOOD |
| 25 | 70° 70° | $2\frac{7}{8}$ | $\frac{1}{4} \times 1\frac{3}{8}$ | RED OAK |
| 26 | 88° 90° | $2\frac{5}{8}$ | $\frac{5}{16}$ ROUND | BIRCH HARD MAPLE |
| 27 | 90° 70° | $\frac{13}{16}$ | 1 QU'RT'R ROUND | PINE |
| 28 | 70° 70° | $1\frac{3}{8}$ | $\frac{3}{8} \times 2\frac{1}{2}$ | RED OAK |
| 29'30 31'32 | 32 31 30 29 | 29 7/8; 30 15/16; 31 1¼; 32 1⅛ | $\frac{3}{4} \times 2\frac{1}{2}$ | PINE BASS WOOD |
| 33 35 | 70° 35 33 70° | 33 3; 35 $2\frac{3}{8}$ | $\frac{1}{4} \times 1\frac{1}{8}$ | RED OAK |
| 34 | 70° 70° | $2\frac{7}{8}$ | $\frac{1}{4} \times \frac{1}{2}$ | RED OAK |
| 36 | 70° 70° 70° | $1\frac{1}{8}$ | $\frac{3}{4} \times 1\frac{3}{8}$ | PINE BASS WOOD |
| 37 | 90° 88° 70° | 5 | $\frac{1}{2} \times \frac{3}{4}$ | PINE BASS WOOD |

FIG. 1D
| NO. | PIECES | LENGTH INCHES | STOCK INCHES | WOOD SPECIES |
|---|---|---|---|---|
| 38 | 90° 70° 70° | $1\frac{1}{16}$ | $\frac{3}{4} \times 1\frac{1}{4}$ | PINE BASS WOOD |
| 39 | 70° 90° | $1\frac{1}{8}$ | $\frac{3}{4} \times 2\frac{1}{2}$ | RED OAK |
| 40 | 70° 70° | $2\frac{3}{8}$ | $\frac{3}{4} \times 2\frac{1}{2}$ | RED OAK |
FIG. 3A
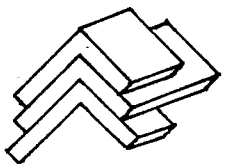
FIG. 3B
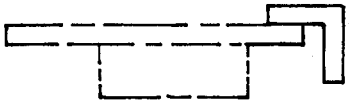
FIG. 3C
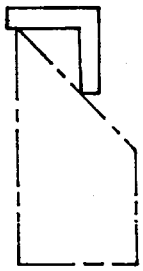

BALANCING SKILL GAME

This is a continuation of co-pending application Ser. No. 06/894,284 filed on Aug. 7, 1986, now abandoned.

BACKGROUND OF THE INVENTION

The field of the invention pertains to parlor games of hand-eye coordination and skill, in particular, to games comprising the balancing of objects, one atop the other such as odd shaped blocks.

The balancing of blocks, most commonly wooden blocks and cards, most commonly playing cards, is known from antiquity. Although such a balancing of blocks or cards to form a construct can be accomplished easily with uniform blocks or uniform playing cards, more challenging are non-uniformly shaped blocks or non-uniform playing cards.

An example of a balancing skill game with non-uniformly shaped wooden blocks is BLOCKHEAD!, recently put on the market by Pressman Toy Corporation of New York, N.Y. BLOCKHEAD! consists of twenty wooden blocks of substantially identical wood and painted in bright colors. Many of the blocks are identical pairs and the blocks are of generally simple shapes with characteristics obvious to the eye.

SUMMARY OF THE INVENTION

With a view toward developing a balancing game more challenging to adults and possessing subtleties not immediately apparent to the eye, applicants have developed a game played with widely varying sizes and shapes of the playing pieces. The pieces or blocks are stacked with balance and counter-balance. Scoring according to the challenging rules and scoring system proceeds with the building of the construct or structure. The result is a game that trains hand-eye coordination while presenting fun and strategic play.

Some of the blocks or playing pieces have been designed with various sizes, shapes, angles and curves that have specific relationships to each other. Other pieces have been designed out-of-balance to visually midlead and complicate play. Certain varieties of wood are selected to use the grain of the wood and rough saw cuts to substantially alter the frictional characteristics of some surfaces of the blocks with respect to other surfaces which are smooth planed. Other varieties of wood are selected to vary the density piece to piece thereby adding further subtle deceptions to the pieces. Further deceptions to the eye are pieces that appear to be cut at a common angle such as 90° but in reality are cut at 88°.

A feature of the rules is that once chosen a piece must be played by adding the piece to the structure. Thus, the hand, the eye, judgment, coordination and experience are all inter-related in playing the game. The game has been found to appeal to men, women and children of all ages and in testing by teachers an excellent teaching aid and reward device in the classroom. Physical therapists have found the game effective and valuable in the training of eye and hand coordination and in the development of fine motor skills.

DESCRIPTION OF THE DRAWINGS

FIGS. 1A, 1B, 1C and 1D chart the pieces of the game set in the preferred embodiment disclosed below;

FIGS. 3A, 3B and 3C illustrate certain combinations of pieces.

DESCRIPTION OF THE PREFERRED EMBODIMENT

Figure 2:
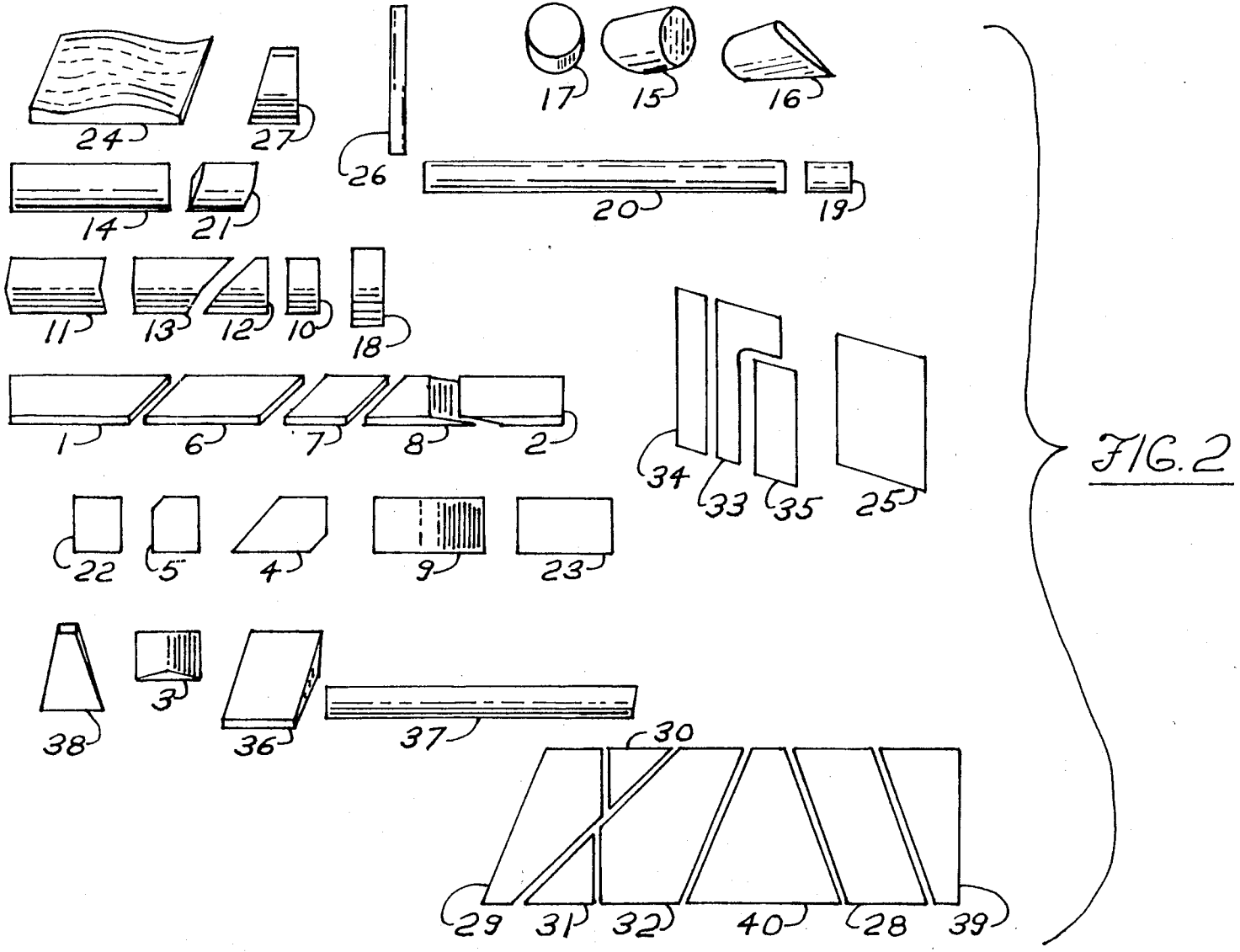
FIG. 2 illustrates the full set of blocks laid out on a flat surface.

Although not necessarily limited to forty pieces or blocks of various sizes, shapes, densities or surface textures, the game is described below in terms of a specific game with a specific set of rules. However, the game set and rules can be varied without exceeding the principles of the invention embodied in this disclosure.

In the preferred embodiment the forty pieces are constructed of wood although the game is not limited to wooden pieces. Within the set there is some variability in surface texture and density among pieces of the same wood species. More importantly, differing wood species provide a wider variety of densities among the pieces in the set.

In the preferred embodiment the wood grain is accentuated or minimized by rough sawing or smooth planing to add a pronounced frictional variable to the game. Certain pieces have been selected to have rough surfaces upon which other pieces can rest only because of the friction.

As is clear from FIG. 2 there is a substantial variety in the sizes and shapes of the forty pieces. In the preferred embodiment no two pieces are identical, however, a game set could be constructed with some pairing or mirror imaging among pieces. The substantial variety in the sizes of pieces creates balance and counter balance situations of simplicity or complexity as the game is played.

The combinations of angles and curved surfaces likewise add complexity to the game when played in combination. Some shapes create visual illusions of the balance point or best balancing end. The angles are nominally 90°, 70° and 45° to the axis of a piece or between surfaces on a piece. However, some pieces of relatively simple shape are formed at 88° on one end to create the illusion that the end is parallel to the other end. Various angle combinations in some blocks bring play in or out of vertical or horizontal alignment, increasing or reducing balance stability.

Referring to the pieces numbered 1 through 40 in FIGS. 1 and 2 in detail, their purposes, advantages and disadvantages are as follows.

(a) A number of pieces combine angles or opposing planar surfaces to return the construct to horizontal play:

70° versus 90°- 27, 29, 32, 36, 37, 39

45° versus 90°- 1, 2, 4, 12, 13, 15

(b) Visual illusion between pieces in the similar small 45° surface on a corner. Piece 4 will balance on small surface. The height of piece 5 precludes balance.

(c) Large high density red oak piece 40 creates the illusion that piece cannot easily be balanced on small flat apex surface.

(d) Pieces 10, 11, 12, 13, 18 are shaped to nest as illustrated in FIG. 3A; to hang as illustrated in FIG. 3B or to increase the playing surface of a 45° or 70° piece as illustrated in FIG. 3C.

(e) Piece 33 combines both hooking and hanging.

(f) Piece 24 is large but light being formed of low density redwood. If played on curved surface, piece is not stable and easily tilts. Piece has small lip at one end to facilitate play with other curved surfaces and must be carefully selected as lip is not immediately noticeable visually.

(g) Piece 25, formed of red oak, gives appearance of high weight, however, the width, length and thickness relationship creates a stabillizing and leveling piece.

(h) Piece 19 is smallest piece in set and is useful when construct is critically balanced.

(i) Piece 21 is quarter round and formed at 70° at each end to create illusion that piece will balance when placed on either end, however, weight to height relationship causes piece to balance on only one end on a horizontal surface.

(j) Piece 14 is formed long and narrow for use in bridging. With quarter round curve and 90° angle end combination, although long and narrow, the ends are large enough to give good vertical stability.

(k) Pieces 15, 16 are cylinders with biased ends to add complexity to play. Piece 16 adds to the complexity by being formed with one end made smooth and the other end made very rough for a substantially different friction characteristic.

(l) On pieces 1, 2, 6, 7, 8 the ends are rough cut to raise end grain for a substantially increased frictional characteristic which is particularly useful when playing angle to angle contact of surfaces between pieces.

(m) Piece 9 is a small light triangle with the apex trimmed to a small flat area to create a very small but limited area of stability.

(n) Pieces 3, 30, 31 are three different sized triangles most useful as wedges to stabilize a construct.

(o) Piece 26 has the smallest end to length relationship for difficult vertical balance. To make the piece even more of a challenge one end is formed at 88°.

Although the pieces or blocks can be merely played until the construct topples or a player can find no piece he is willing to try to add, a set of rules to make the game or a series of games more interesting has been devised. The game can be played by an individual, by multiple players or by teams and the object of the game remains to assemble a balanced structure on a stable playing surface using all or as many pieces as possible.

Under the rules the game is played in three parts; game, set and match. Three games equal a set and three sets equal a match. The winner is determined by the highest score obtained by a player or team completing the play of a match.

The pieces should be randomly distributed like the pieces of a puzzle. A first player is selected in any manner and the first player selects a piece and places it on any side or end on the playing surface. The first piece is the base. The next player then selects a piece and balances the second piece on the base without having the second piece touch the playing surface. Play continues by players adding pieces to previous pieces or the base and maintaining the balance of the construct until all forty pieces are used or the construct falls. Thereupon the game ends.

One of the most important rules is that once chosen (picked up) the player is obligated to play that piece without dropping the piece or touching with his hands any of the previously played pieces in the construct.

A player forfeits his turn if he drops the selected piece, if only his piece drops from the construct after he has played the piece or if he returns his piece to the playing surface. Should the player cause any previously played and balanced pieces to fall from the construct, the game ends. If all of the players forfeit in turn, the game ends.

Scoring is accomplished in the following manner. Upon a drop or fall of a piece as above all other players score one point. Points equal to the total number of pieces in the construct will be given to the last successful player before game ends. In addition, all players except the losing players receive five points and a new game begins with the next player. If, however, the game ends because all players forfeit, the only points awarded will be given to the last successful player.

In addition, points are awarded to players based on the number of pieces previously played. The player who successfully places the 10th, 15th, 20th, 25th, 30th, 35th or 40th piece in balance on the construct is awarded additional points as follows:

| Pieces | Points |
|---|---|
| 10 | 5 |
| 15 | 10 |
| 20 | 20 |
| 25 | 25 |
| 30 | 30 |
| 35 | 35 |
| 40 | 40 |

Where teams play the combined score of all team members determines the score. The individual player or team accumulating the highest score in a set receives a ten point bonus and the highest score at the end of three sets wins the match.

In developing the preferred embodiment of the game disclosed above the pieces and the rules have been carefully matched to provide an exciting challenge. Other embodiments to increase or decrease the challenge can be easily envisioned within the basic principles of the game.

We claim:

1. Parlor game sets of blocks, each set being identical to the other sets and comprising individual sets of blocks each having a plurality of differing solid geometric shapes, surface textures and at least some of said blocks in each set appearing to be of common shape but actually differing from the common shape an amount not easily discernable to the eye, said differences from the common shape being identical to the corresponding blocks of the other sets of blocks for the same parlor game, the blocks further differing in the density of the materials from which the blocks are constructed and in each set at least one of the blocks includes at least two parallel planar surfaces with a uniform cross-section therebetween and the center of gravity of the block so located that level placement of the block on one of the two parallel planar surfaces causes the block to topple whereas level placement on the other planar surface leaves the block stable.

2. The parlor game sets of claim 1 wherein the blocks are constructed of wood and at least some of said blocks of relatively larger size are lower in density than other blocks of relatively smaller size and higher density.

3. The parlor game sets of claim 1 wherein the blocks are constructed of wood, the surface texture on at least one surface of each of a plurality of blocks differing from the surface texture of the other surfaces of each said plurality of blocks.

4. The parlor game sets of claim 1 wherein in each set at least one of the blocks appearing to be of common shape includes at least two planar surfaces appearing to be parallel, said two planar surfaces being non-parallel by a small angle not easily discernable with the human eye.

5. The parlor game sets of claim 4 wherein said two planar surfaces are nonparallel by approximately two degrees.

* * * * *